343-754 SR
5/25/76 XR 3,959,794

United States Patent [19]
Chrepta et al.
[11] 3,959,794
[45] May 25, 1976

[54] SEMICONDUCTOR WAVEGUIDE ANTENNA WITH DIODE CONTROL FOR SCANNING

[75] Inventors: Metro M. Chrepta, Neptune; Harold Jacobs, West Long Branch, both of N.J.

[73] Assignee: The United States of America as represented by the Secretary of the Army, Washington, D.C.

[22] Filed: Sept. 26, 1975

[21] Appl. No.: 617,211

[52] U.S. Cl. ..... 343/701; 343/754; 343/785
[51] Int. Cl.[2] ..... H01Q 3/26
[58] Field of Search ..... 343/701, 754, 755, 785, 343/854

[56] References Cited

UNITED STATES PATENTS 2,921,308 1/1960 Hansen et al. ..... 343/787

*Primary Examiner*—Eli Lieberman
*Attorney, Agent, or Firm*—Nathan Edelberg; Robert P. Gibson; Daniel Sharp

[57] ABSTRACT

A single element line scanner applicable to millimeter or submillimeter wave beam steering which includes a semiconductor waveguide made of a high resistivity bulk single crystal intrinsic semiconductor material such as silicon. Parallel spaced radiator elements are disposed on one major or top surface of the semiconductor waveguide transverse to the direction of wave propagation along the waveguide. Parallel spaced PIN diodes are disposed on the other or bottom major surface of the semiconductor waveguide transverse to the direction of wave propagation. The PIN diodes are spaced close enough to prevent radiation from escaping outwardly from the bottom major surface and are provided with a variable forward bias to produce a conductivity sheet. The conductivity sheet on the bottom major surface is electronically modulated as a function of the bias current for a given frequency and the variation of such a conductivity sheet changes the wavelengths in the semiconductor waveguide. The changing wavelengths provide variable wavelength spacing between the spaced radiator elements. Each variation of wavelength corresponds to a discrete angle of radiation reinforcement from the radiator elements such that there is provided a single radiation lobe pattern which may be scanned through 180 degrees.

11 Claims, 5 Drawing Figures

FIG. 1
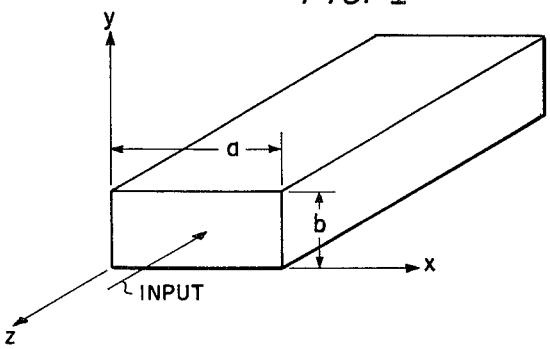
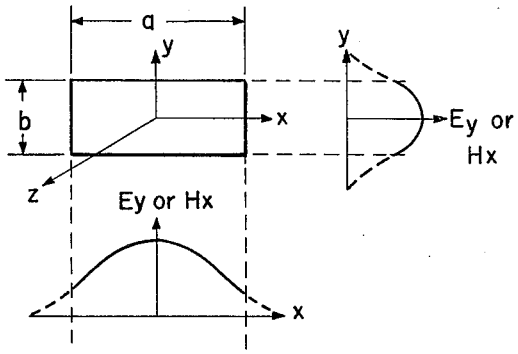
FIG. 2
FIG. 3
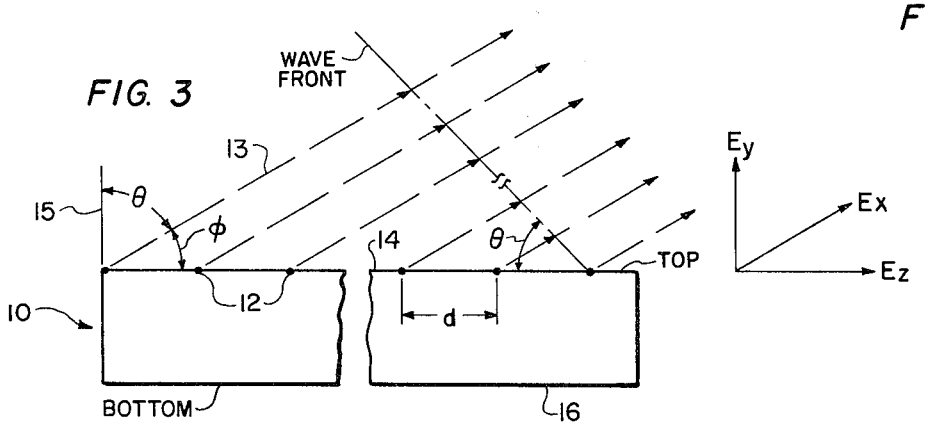
FIG. 4
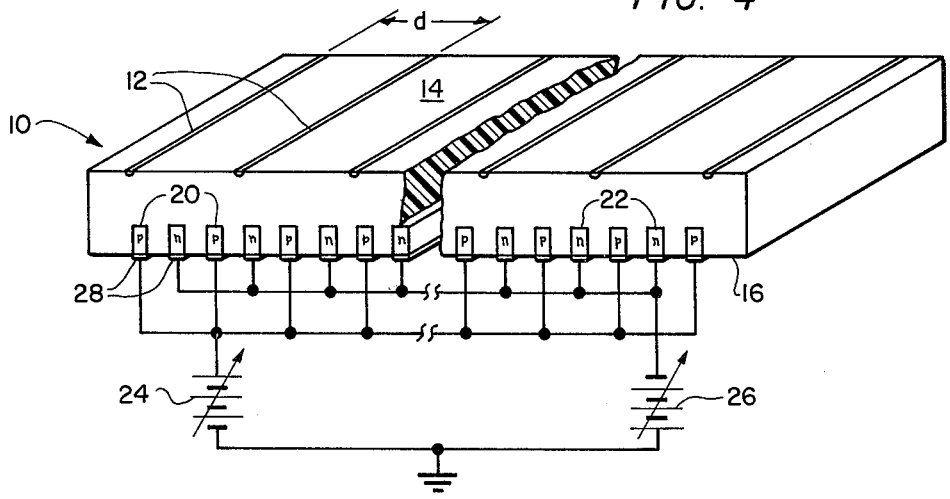
FIG. 5
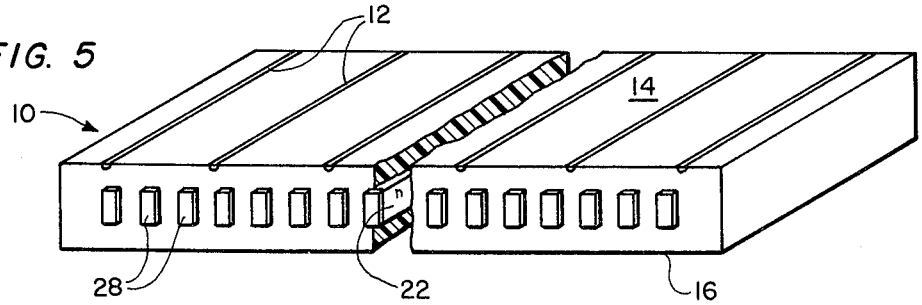

SEMICONDUCTOR WAVEGUIDE ANTENNA WITH DIODE CONTROL FOR SCANNING

The invention described herein may be manufactured and used by or for Governmental purposes without the payment of any royalties thereon or therefor.

BACKGROUND OF THE INVENTION

This invention relates to line scanners and more particularly to single element line scanner devices applicable to millimeter wave beam steering.

One of the biggest drawbacks in present day millimeter phased array systems is the power and frequency limitations of the individual ferrite phase shifting elements normally utilized in such systems to provide beam steering. Each radiating element of the array is controlled by an individual phase shifting element which requires a minimum of space and considerable power since power splitting is required to feed each ferrite phase shifter. This results in high power consumption and great difficulty in switching the individual phase shifting elements. Moreover as the millimeter operating wave region reaches 35GHz and above, there is a considerable problem in ferrite design to produce operative phase shifters. At 94GHz and above, for example, ferrite phase shifters are non-existent since present design technology is lacking for fabricating ferrite phase shifters which will operate at such high frequencies.

BRIEF SUMMARY OF THE INVENTION

It is an object of the present invention to provide a single element scanner which overcomes all the aforesaid limitations.

It is another object of the present invention to provide a single element line scanner which has low cost potential, is simple to construct and very easy to adjust.

In accordance with the present invention the single line scanner includes a semiconductor waveguide of rectangular cross section adapted to propagate wave energy in the $E_{11}^y$ mode. The wave energy is propagated along the Z axis of the waveguide transverse to the cross-sectional dimensions corresponding to the X and Y axes of the waveguide. A plurality of spaced parallel radiator elements are embedded in the one wide or top surface of the waveguide transverse to the Z axis of wave propagation. Included further are spaced parallel PIN diodes disposed either on the bottom or sidewall surface of the waveguide transverse to the Z axis. The PIN diodes are spaced close enough to prevent outward radiation from the bottom or sidewall surface of the waveguide. The PIN diodes are also provided with a variable forward bias source by means of which a variable electronic conductive sheet is applied on the surface of the waveguide which includes the PIN diodes. The forward bias is varied to effectively electronically modulate the conductive sheet so that the wavelength in the semiconductor waveguide is changed as a function of bias current for a given frequency. The modulation of the bottom or sidewall surface conductivity sheet thus changes the wavelength in the waveguide even though the frequency is kept constant. The change in wavelength also electronically changes the wavelength spacing between the radiator elements on the top surface of the waveguide. These changes in spacing provide for reinforcement of the radiated energy at a prescribed scan angle to produce radiation lobe patterns at prescribed angles. With a proper choice of the type of dielectric forming the semiconductor waveguide and the magnitude of forward bias applied, the radiation lobe pattern provides a line scan which may be varied over a range of 180°.

BRIEF DESCRIPTION OF THE DRAWINGS

FIG. 1 shows an intrinsic semiconductor waveguiding medium adapted to propagate the $E_{11}^y$ mode;

FIG. 2 illustrates a typical field configuration for the fundamental $E_{11}^y$ mode in the waveguiding medium of FIG. 1;

FIG. 3 is an explanatory drawing;

FIG. 4 illustrates a preferred embodiment of the present invention; and

FIG. 5 illustrates another embodiment of the present invention.

DETAILED DESCRIPTION OF THE INVENTION

For purposes of better understanding the subject invention, it will be helpful to consider the propagation of a quasi-optical wave along the Z axis of a bulk semiconductor strip of material having a high resistivity, of the order of at least 10,000 ohm-cm and a high dielectric constant. Semiconductor or dielectric waveguides which meet these requirements include silicon and gallium arsenide. In such semiconductor waveguides the power attenuation, which is an inverse exponential function of conductivity, is substantially negligible in the millimeter and submillimeter frequency range of interest. It has been shown that very little loss of quasi-optical wave energy occurs outside the waveguide, provided the usual care is taken to tailor the dimension of the waveguide to the desired frequency range of operation which, of course, requires that the transverse dimension of the semiconductor strip be greater than approximately one-half wavelength in the semiconductor material.

FIG. 1 shows such an intrinsic semiconductor waveguide of rectangular cross section of width *a* and height *b*. In such waveguides the mode exhibiting the lowest loss is the $E_{11}^y$ mode which is the fundamental wave mode propagated along the Z axis. The distribution of the E and H fields in both the X and Y directions (directions mutually transverse to the Z direction along which the millimeter or submillimeter wave propagates) is shown in FIG. 2. It will be noted that the evanescent E and H field exists beyond the physical boundaries of the waveguide structure. By providing parallel arranged conductive wires on one major surface of the semiconductor waveguide transverse to the Z axis, the propagated $E_{11}^y$ mode will interact with the wires such that a radiation pattern may be produced which forms the basis of the present invention.

Referring now to FIG. 3, the intrinsic single crystal semiconductor waveguide 10 is provided with parallel and uniformly spaced conductive wires 12 embedded in one major or top surface 14 of the semiconductor waveguide 10 transverse to the propagation axis Z. The spacing between the wires is shown as d. The wires 12 are exposed along the major surface 14 so as to interact with the wave energy propagated along the Z axis in the $E_{11}^y$ mode. From FIG. 2 it can be seen that there is a small component of electric field in the X direction so that a very small amount of current would be generated and each cross wire 12 would, in effect, become a radiator or antenna element. Along the Z or propagating axis, this current would behave in accordance with the following equation.

$$I_x = I_o e^{-jk_z nd} \quad (1)$$

where $I_o$ = amplitude of current (radiated)

kz = propagation constant along the Z axis $n$ = discrete wire element on the semiconductor waveguide $d$ = spacing between wires.

If it is now assumed that the radiating wires 12 provide a coherent energy wavefront, then the parallel radiated rays 13 forming the wavefront will be refracted from major surface 14 at an angle of refraction which is the angle of the normal 15 with respect to the ray direction. Accordingly, the radiation from each wire element 12 in the Y direction or air region would behave in accordance with the following equation $$I_x = I_o e^{-jknd \sin\theta} \quad (2)$$

where $I_o$ = current amplitude $k$ = propagation constant along the ray direction (air)

$\theta$ = angle of refraction which is also equal to the angle the wavefront makes with the Z propagation axis (or the angle of the normal with respect to the ray direction)

In order to provide a condition for reinforcement of the wave energy at which such energy can escape from the system in a forward direction, at angles of refraction $\theta$ varying from 0 to $\pi/2$, the relationship of the exponential components of equation 1 and 2, which represent phase, will be $$k_z nd - knd \sin\theta = m\, 2\pi \quad (3)$$

where $m$ is an integer ($m = 0, +1, +2$, etc. and where $m = 1$ is the primary lobe. For $n = 1$, that is for phase emanating from successive wire radiators, we have for the primary lobe $$d\,(k_z - k \sin\theta) = m\, 2\pi \quad (4)$$

Since $$k_z \cong \frac{\frac{2\pi}{\tau_{air}}}{\sqrt{\epsilon}},$$

where $\epsilon$ is the dielectric constant of the semiconductor waveguide element and $\tau$ is the wavelength in air, and since $$k_{air} = \frac{2\pi}{\tau_{air}}$$

then these values may be substituted in equation 4 so that $$d\left(\frac{\frac{2\pi}{\tau_{air}}}{\sqrt{\epsilon}} - \frac{2\pi}{\tau_{air}}\right)\sin\theta = 2\pi \quad (5)$$

and from equation 5 we have $$\frac{d}{\tau_{air}}\left(\sqrt{\epsilon} - \sin\theta\right) = 1 \quad (6)$$

which may be presented as $$\sqrt{\epsilon} - \sin\theta = \frac{\tau_{air}}{d} \quad (7)$$

It is to be noted that $\sqrt{\epsilon}$ equals the index of refraction $\eta$ of the semiconductor 10 in accordance with the well known Maxwell relationship where $\epsilon = \eta^2$, $\eta$ being the refractive index.

For high resistivity silicon, whose dielectric constant is 12 and the index of refraction is 3.46, reinforcement will occur under the condition given by equation 7 which is $$(3.46 - \sin\theta) = \frac{\tau_{air}}{d} \quad (8)$$

for the first main reinforcement factor or primary lobe. For the condition of nonreinforcement for any given wire spacing d at which no radiated energy escapes, that is when the random radiations cancel out statistically, we have the following equation $$3.46 - \sin\theta < \frac{\tau_{air}}{d} \quad ; 0 < \theta < \frac{\pi}{2} \quad (9)$$

The condition in which there is no reinforcement and hence no radiation escaping at all in which the $E_{11}^y$ mode is propagated without loss may best be considered by assuming operating parameters. If it is assumed that the system is operating at 15GHz where $\tau = 2$ cm in air, and the silicon waveguide is appropriately dimensioned for $E_{11}^y$ mode of operation, then where the angle $\theta = 0$ and $m = 1$, we have from equation 9

$$3.46 - 0 = \frac{\tau_{air}}{d} \quad (10)$$

or $$d = \frac{2}{3.46} = 0.58 \text{ cm} \quad (11)$$

Thus under these conditions, if the spacing between radiator elements is <.58cm there will be no radiation energy escaping and no reinforcement in the forward direction. For angle of escape, i.e., $\theta = \pi/2$ and m = 1, the grazing allowed spacing is given as follows $$3.46 - 1 = \frac{\tau_{air}}{d} \quad (12)$$

or $$d = \frac{2}{2.46} = 0.81 \text{ cm} \quad (13)$$

Thus at a $\tau$ of 2cm, radiated energy will escape for reinforcement when $d$ is between 0.58 and 0.81cm. It can be seen from the above that the controlling factor for providing escaping radiation is the distance or spacing d between wire radiators 12 for a given frequency, and that for a semiconductor waveguide of given dielectric constant $\epsilon$, the angle of radiation reinforcement to provide escape at a prescribed scan angle will depend on the wavelength spacing between the radiating elements 12. FIG. 4 illustrates a preferred embodiment of the present invention which operates in accordance with the principles hereinabove described.

Referring now to FIG. 4, 10 is an intrinsic semiconductor waveguide, preferably silicon, of rectangular cross section whose dimensions are determined by the operating frequency desired. Partially embedded on one wide or top surface 14 of silicon waveguide 10 are parallel spaced bars or wire conductors 12 positioned transverse to the Z axis of propagation. The bars or conductors 12 may comprise well known alloyed ohmic contacts. Since the conductors 12 are partially embedded in major surface 14, a portion of these conductors are exposed to interact with the propagated $E_{11}^{y}$ mode wave energy to provide radiation from conductors 12 as hereinabove described. The spacing between radiator elements 12 is determined in accordance with the parameters derived in connection with equations 8–13 so that reinforcement energy may escape from radiators 12 and the radiated lobe angles resulting therefrom will be a function of the wavelength spacing between radiators 12.

On the other wide or bottom surface 16 of a semiconductor waveguide 10, there are provided a plurality of alternately spaced p-type doped strips 20 and n-type doped strips 22 transverse to the Z axis of propagation. The alternate regions 20 and 22 of opposite conductivity type are maintained at opposite polarity by being connected to opposite polarized power supplies 24 and 26. The necessary electrical connections are made to respective electrodes 28 which may be a thin metallic layer formed on the surfaces of the doped strips by any of the usual integrated circuit techniques. The parallel spaced p and n type strips are transverse to the Z axis of propagation and are closely spaced to prevent radiation therefrom, approximately 1 mm apart. A given p type doped strip such as 20, the adjacent n type doped strip 22, and the portion of intrinsic semiconductor waveguide 10 lying therebetween combine to form a forward biased PIN diode. No radiation will escape from the bottom surface 16 since metallization occurs with spacing which is too small for escape. The forward biased PIN diode provides an electronic sheet whose conductivity may be varied in accordance with the bias current. The variation of such a conductivity sheet with changing current bias changes the wavelengths in the silicon waveguide 10. Thus, the conductivity sheet on bottom surface 16 of silicon waveguide 10 is electronically modulated to change the wavelength on the silicon waveguide even though the frequency is kept constant. This principle is clearly explained on pages 411–417 of IEE MTT, Vol MTT-22, No. 4, April 1974 which is authored by the applicants. Thus by changing the wavelength in the silicon waveguide, there is provided a variation in the angle of the $m = 1$ lobe which is a function of the biasing or modulating current. With the change in wavelength in the silicon waveguide 10, the wavelength spacing $d$ between radiators is accordingly varied in accordance with the modulating bias current so that effectively the angle of reinforcement or angle of refraction is also varied accordingly. For example, for $m = 1$ we have the relationship $$3.46 - \sin\theta = \frac{\tau}{d}$$

as in equation 8. If the radiating elements 12 on top surface 14 were originally physically spaced 0.5cm apart and the wavelength in the silicon waveguide is now changed by current bias modulation so that the wavelength distance d is also changed, the angle of reinforcement may be readily determined. Assuming a spacing wavelength $d = 0.66$cm and $\tau_{air} = 2$, then for reinforcement at $m = 1$, we have $\sqrt{\epsilon} - \sin\theta = 2.0/.66 = 3$ or $\sin\theta = \sqrt{\epsilon} - 3 = 3.46 - 3 = 0.46$ and $\theta = 27°$ which is the angle of reinforcement. That is, the scan lobe wavefront pattern is 27° with respect to the Z axis of propagation. Thus the variation of the bias current on bottom surface 16 will vary the angle of reinforcement and thereby provide a single lobe pattern which may be scanned through 180 degress.

FIG. 5 shows another embodiment of the invention. In FIG. 5, the PIN diodes are disposed in one narrow or sidewall 17 transverse to the Z axis of $E_{11}^{y}$ mode of propagation. As in FIG. 4, the PIN diodes are spaced close enough to prevent radiation therefrom and are forward biased. The principle of operation of FIG. 5 is identical to that described in connection with FIG. 4. Thus the forward biased PIN diodes provide an electronic sheet whose conductivity may be varied in accordance with the bias current. The conductivity sheet on narrow surface 17 of waveguide 10 is electronically modulated to change the wavelength in the silicon waveguide even though the frequency is kept constant. With change in wavelength, the distance d is changed as explained in connection with FIG. 4.

What is claimed is:

1. A single line scanner comprising:

a semiconductor waveguide of rectangular cross section adapted to propagate wave energy in the $E_{11}^{y}$ mode along a prescribed axis transverse to the dimensions of said cross section;

said waveguide having top and bottom surfaces parallel to said axis;

a plurality of spaced parallel radiator elements on said top surface transverse to said prescribed axis in the path of said propagated wave energy;

means affixed to another surface to prevent outward radiation therefrom as wave energy is propagated along said waveguide; and means in circuit with said radiation prevention means for changing the wavelengths in said waveguide at a given frequency of operation to control the wavelength spacing between said radiator elements whereby radiated energy is reinforced to produce a radiation lobe pattern at a prescribed angle with respect to said propagating axis.

2. The single line scanner in accordance with claim 1 wherein said waveguide is made of silicon.

3. The single line scanner in accordance with claim 1 wherein said radiator elements comprise alloyed ohmic bars.

4. The single line scanner in accordance with claim 1 wherein said radiation preventing means comprise a plurality of spaced PIN diodes transverse to said prescribed axis.

5. The single line scanner in accordance with claim 4 wherein the means for changing the wavelength spacing comprises a variable voltage source for forward biasing said PIN diodes, the angle of reinforcement being a function of the value of the applied forward bias.

6. The single line scanner in accordance with claim 4 wherein said PIN diodes each comprise spaced p and n type doped strips.

7. The single line scanner in accordance with claim 2 wherein said radiator elements comprise alloyed ohmic bars embedded in said silicon a portion of said bars being exposed to interact with said propagated $E_{11}^{y}$ mode wave energy.

8. The single line scanner in accordance with claim 5 wherein said other surface is said bottom surface.

9. The single line scanner in accordance with claim 5 wherein said other surface is a sidewall surface of said waveguide.

10. The single line scanner in accordance with claim 8 wherein said waveguide is made of silicon.

11. The single line scanner in accordance with claim 9 wherein said waveguide is made of silicon.

* * * * *